United States Patent [19]

Wainwright

[11] 4,121,093

[45] Oct. 17, 1978

[54] SURFACE HEATING EQUIPMENT

[75] Inventor: Geoffrey Hugh Wainwright, Hale, England

[73] Assignee: Heat Trace Limited, Stockport, England

[21] Appl. No.: 745,336

[22] Filed: Nov. 26, 1976

[30] Foreign Application Priority Data

Nov. 29, 1975 [GB] United Kingdom ..... 49185/75

[51] Int. Cl.[2] ..... H05B 3/34

[52] U.S. Cl. ..... 219/528; 219/535; 219/541; 219/544; 338/212

[58] Field of Search ..... 219/521, 528, 529, 535, 219/543, 544, 545, 549; 338/212, 214

[56] References Cited

U.S. PATENT DOCUMENTS

| | | | |
|---|---|---|---|
| 1,036,632 | 8/1912 | Jahr | 219/545 X |
| 1,869,629 | 8/1932 | Stranszky | 219/545 |
| 2,494,589 | 1/1950 | Sletner | 338/214 X |
| 2,719,907 | 10/1955 | Combs | 219/528 |
| 2,759,092 | 8/1956 | Fortin | 219/545 X |
| 2,782,289 | 2/1957 | Nathamson | 219/528 X |
| 2,812,409 | 11/1957 | Jones et al. | 219/545 X |
| 3,341,690 | 9/1967 | Comming | 219/528 |
| 3,527,925 | 9/1970 | Toyooka et al. | 219/521 |
| 3,757,086 | 9/1973 | Indoe | 219/528 |
| 3,959,622 | 5/1976 | Bohdonov | 219/549 |

FOREIGN PATENT DOCUMENTS

| | | | |
|---|---|---|---|
| 116,448 | 3/1946 | Sweden | 338/214 |

*Primary Examiner*—J. V. Truhe
*Assistant Examiner*—M. Paschall
*Attorney, Agent, or Firm*—Sughrue, Rothwell, Mion, Zinn and Macpeak

[57] ABSTRACT

A heating tape is described which comprises two longitudinally extending foil conductors and a longitudinally extending tape incorporating heating elements spaced apart along its length. The heating elements are connected electrically in parallel between the heating foils, enabling the heating tape to be powered from one end.

4 Claims, 4 Drawing Figures

SURFACE HEATING EQUIPMENT

The present invention relates to surface heating equipment, and in particular to electric heating tapes.

Electric heating tapes are used for example for heating the surface of pipes. The tapes are spiralled around or positioned along the length of the pipes and usually covered with the pipes in thermal insulation. Power is supplied to the tapes, usually under the control of for example, thermostats so that the temperature of the pipe is raised to, maintained at or prevented from falling below a predetermined temperature. Arrangements of this type can be used in various circumstances, such as with water-carrying pipework which requires protection against frost damage.

Known heating tapes are generally of a type incorporating two or more longitudinally extending heating elements with connecting terminals at the supply end of the tape with series, parallel, or series and parallel connections at the neutral end of the tape. A circuit must be defined which comprises two conductive paths extending from the terminals at one end of the tape to the other end to enable the passage of current through the heating element. Such an arrangement is disadvantageous as the tape cannot be cut to fit a particular situation and must accordingly be produced in predetermined lengths. The tape cannot be cut as, if it were, the longitudinally extending circuit would be broken, rendering the tape useless. Different situations can require a wide variety of tape lengths, requiring the production and storage of a large number of different tapes and thus increasing costs.

Heating tapes having widely varying power outputs are required to fit different situations. Conventional heating tape construction requires structural and componental differences between tapes of different outputs, for example in the number, characteristics and arrangement of the heating elements. This further complicates production.

It is an object of the present invention to obviate or mitigate the above problems.

According to the present invention, there is provided a heating tape comprising two longitudinally extending foil conductors and a longitudinally extending tape incorporating heating elements spaced apart along its length, the heating elements being connected in parallel between the two foil conductors.

Preferably the longitudinally extending tape into which the heating elements are incorporated is woven. The woven tape may comprise for example a warp of non-conductive material and a weft of conductive material, the conductive material being connected at predetermined intervals to the two foil conductors so that the conductive material forms a plurality of elements connected in parallel between the foil conductors.

The non-conductive material is preferably glass fibre and the conductive material is preferably a wire which is continuous from one end to the tape to the other.

Embodiments of the present invention will now be described, by way of example, with reference to the accompanying drawings, in which.

Figure 1:
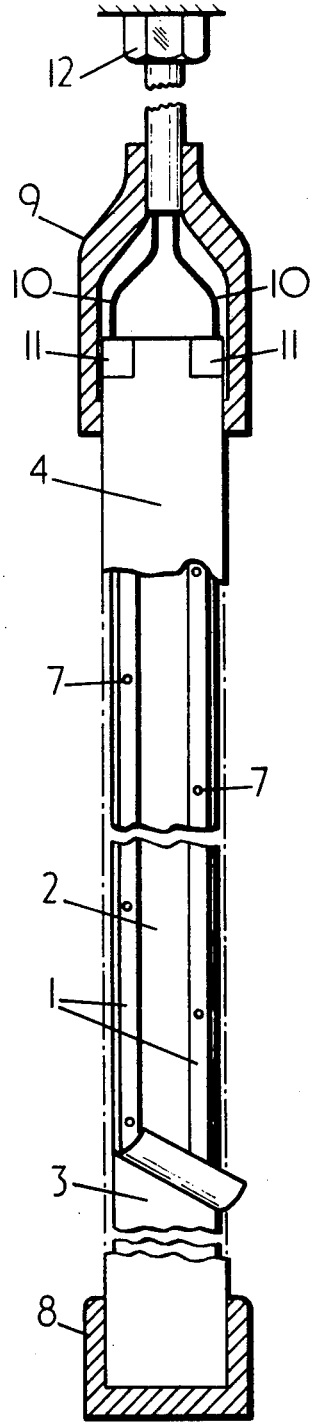
FIG. 1 shows a cut-away view of a first heating tape according to the invention

In FIG. 1, a heating tape is illustrated which comprises a pair of copper foil conductors 1 supported on one side of a flexible non-conductive glass-cloth tape 2. The glass cloth tape 2 is laid on a woven tape 3 with the conductors 1 facing away from the woven tape 3. The entire assembly is coated with an extruded weatherproof outer sheath 4 of for example PVC or silicone rubber. The copper conductors 1 may have a plated finish.

Figure 2:
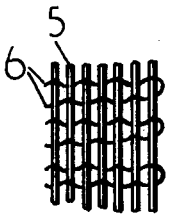
FIGS. 2 and 3 show details of two component parts of the heating tape of FIG. 1.

Referring now to FIG. 2 an edge portion of the woven tape 3 is shown in detail to illustrate the arrangement of glass fibre yarn 5 as the warp (longitudinal) and wire 6 as the weft (transverse). The wire 6 is continuous at the edges of the woven tape 3 so that the ends of each weft thread are electrically connected to a respective one of the two adjacent weft threads. The wire 6 is thus continuous from one end of the woven tape 3 to the other. The wire 6 may be for example nickel alloy resistance wire.

The conductors 1 are electrically connected to the wire 6 in the tape 3 by connectors 7 in the form of rivets, eyelets, staples or the like extending through the conductors 1, glass-cloth tape 2, and woven tape 3. Alternatively, the connectors 7 may be replaced by welded joints for example. The connectors 7 are spaced apart along the length of the conductors 1 and the connectors 7 of one conductor are staggered in the longitudinal direction with respect to those of the other conductor. Thus the connectors form terminals of a series of parallel connected heating elements of equal length, each terminal being connected to two adjacent elements. The spacing between the connectors 7 of each conductor could be for example 30cms with a 15cm stagger between the connectors of the two conductors.

Figure 3:
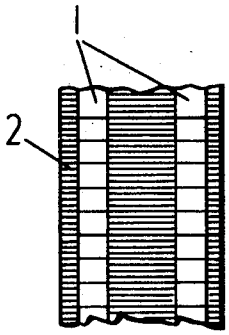

Referring now to FIG. 3, details of the tape 2 are shown. The conductors 1 are retained in position on one side of the tape 2 by loops of the tape woven there around, the main body of the tape being located behind the conductors 1 as shown in FIG. 3 to prevent accidental contact with the tape 3 (FIG. 1).

The heating tape is completed by a water-proof moulded end cap 8 and, where cold tails are fitted, a waterproof moulded termination 9. In the termination 9, cold tails 10 are crimped at 11 to the two conductors 1. The cold tails are connected by a flexible cable to a device 12 adapted for connection to a suitable power supply. It will be appreciated that the wire 6 must not be allowed to directly electrically connect the two crimps 11 across the tape, as if this occurred a short-circuit condition would be established. This condition can be avoided by cutting away the tape 3 between the crimps 11, or by extending the conductors 1 beyond the end of the tape 3 for example.

For a given power supply and wire 6 the power output per foot of the heating tape depends upon the length of the individual heating elements, and this in turn depends upon the spacing between the connectors 7. Thus, a variety of heating tapes having different power outputs can be produced from identical components merely by adjusting the connector spacing. Alternatively, the connector spacing may be maintained constant and the power output determined by the size and/or composition of the wire 6.

Each connector 7 may be replaced by a pair of connectors spaced apart slightly in the longitudinal direction so as to define an unheated portion of the tape therebetween. This enables a tape to be cut between any pair of connectors so that the cut tape does not end with an incomplete heating element.

Figure 4:
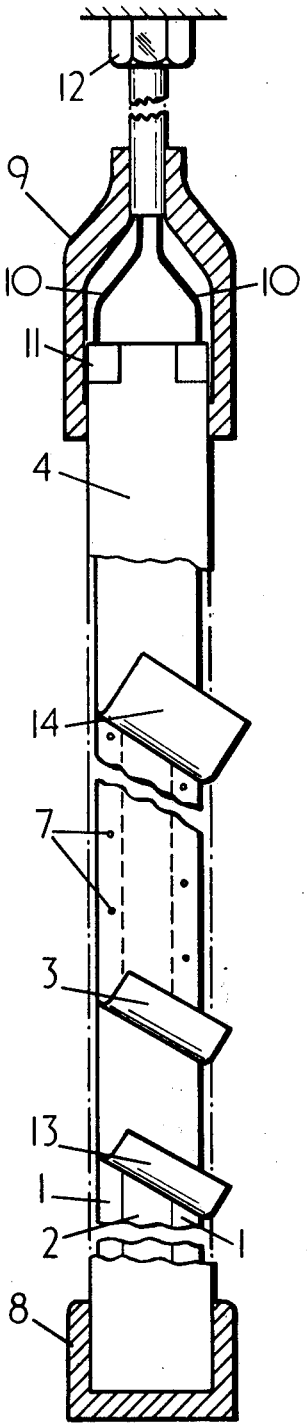
FIG. 4 shows a cut-away view of a second heating tape according to the invention.

Referring now to FIG. 4, an alternative embodiment of the invention is illustrated which comprises, as in the case of the FIG. 1 embodiment, a pair of copper foil conductors 1 supported on a flexible non-conductive glass-cloth tape 2, a woven tape 3, and an extruded waterproof outer sheath 4.

In this embodiment however the conductors 1 are provided on the side of the glass-cloth tape 2 facing the tape 3, and continuous contact between the conductors 1 and tape 3 is prevented by an insulating glass-cloth tape 13 interposed between the conductors and tape 3. Connectors 7 extend through this tape 13. A further insulating tape 14 covers the connectors 7, and the entire "laminate" is encased within the surrounding outer sheath 4.

The construction of the heating tape according to the invention enables it to be cut to any desired length and the end cap and termination can then be added. Thus it is not necessary to produce a wide variety of tape lengths.

The construction of the heating tape also enables its operation to be closely monitored and damage to be easily located and repaired. For example, indicator lights at the end of and/or spaced along the tape would indicate when power was being supplied. If one of the foils were broken, the break could be located with for example an ammeter, and bridged. Thus, breakage of the tape would not necessarily require replacement or an expensive repair operation.

The heating element wire 6 may comprise a simple straight wire or may comprise a wire spiralled onto a flexible wire of, for example, glass fibre prior to the weaving of the tape 3.

Although in the illustrated embodiments the connections between the foil conductors 1 and wire 6 require the positioning of the conductors above the wire 6, it will be appreciated that conductors may be positioned adjacent to the element, for example by securing foil conductor in the edges of the tape 3 and stopping the wire 6 short of the foils. In such a case the foil conductors could be connected to the wire 6 by a bridging strip or other suitable means.

What is claimed is:

1. An electrical heating tape, comprising:

(a) a longitudinally extending, flexible tape having a continuous electrical heating element incorporated therein, said heating element extending from one end of said flexible tape to the other and over substantially the full width of said flexible tape, (b) two spaced apart, longitudinally extending, flexible, electrically conductive foils mounted on one face of said flexible tape overlying said heating element, (c) electrically non-conductive means insulating said foils from said heating element, (d) a plurality of electrically conductive means each penetrating said non-conductive means to individually electrically connect said heating element to said foils at spaced locations along the length of said foils, said electrically conductive connecting means being individually positioned to effect the connection of said heating element in a plurality of longitudinally extending heating circuits each connected in parallel between said foils, and (e) an electrically insulating sheath encasing the assembly of said flexible tape and said foils.

2. A heating tape as claimed in claim 1, wherein said flexible tape is woven and comprises electrically insulating warp threads and said heating element as a continuous weft thread.

3. A heating tape according to claim 2, wherein said foils are retained in position relative to said woven flexible tape by electrically insulating loops woven therearound.

4. A heating tape according to claim 1, wherein said electrically non-conductive means comprises an electrically insulating tape interposed between said flexible tape and said foils, electrical connections being made between said foils and said heating element through said electrically insulating tape.

* * * * *